US009085922B2

(12) United States Patent
Tiemann et al.

(10) Patent No.: US 9,085,922 B2
(45) Date of Patent: Jul. 21, 2015

(54) LOCK OF A HOOD OF A MOTOR VEHICLE

(75) Inventors: Dirk Tiemann, Orbis (DE); Anett Kilian, Trebur (DE); Bernd Klein, Horrweiler (DE); Michael Maas, Schnorbach (DE); Scott Wilbanks, Novi, MI (US)

(73) Assignee: GM GLOBAL TECHNOLOGY OPERATIONS, Detroit, MI (US)

( * ) Notice: Subject to any disclaimer, the term of this patent is extended or adjusted under 35 U.S.C. 154(b) by 245 days.

(21) Appl. No.: 12/992,553

(22) PCT Filed: Jul. 1, 2008

(86) PCT No.: PCT/EP2008/005345

§ 371 (c)(1), (2), (4) Date: Nov. 12, 2010

(87) PCT Pub. No.: WO2009/138112

PCT Pub. Date: Nov. 19, 2009

(65) Prior Publication Data

US 2011/0062726 A1 Mar. 17, 2011

(30) Foreign Application Priority Data

May 14, 2008 (DE) ..... 10 2008 023 490

(51) Int. Cl.

| | |
|---|---|
| ***E05C 3/06*** | (2006.01) |
| ***E05B 85/26*** | (2014.01) |
| ***E05B 77/04*** | (2014.01) |

(Continued)

(52) U.S. Cl.

CPC ..... *E05B 85/26* (2013.01); *E05B 77/04* (2013.01); *E05B 77/10* (2013.01); *E05B 83/16* (2013.01)

(58) Field of Classification Search

CPC ..... E05B 17/0025; E05B 85/26; E05B 85/16

USPC ..... 292/194, 216, 336.3, DIG. 14, DIG. 38, 292/DIG. 56, 11, 201, 195

See application file for complete search history.

(56) References Cited

U.S. PATENT DOCUMENTS

| | | | | |
|---|---|---|---|---|
| 2,877,038 | A * | 3/1959 | Kramer | 292/216 |
| 3,572,793 | A * | 3/1971 | Cole | 292/216 |
| 3,905,624 | A * | 9/1975 | Fujita | 292/11 |

(Continued)

FOREIGN PATENT DOCUMENTS

| | | |
|---|---|---|
| DE | 2103959 A1 | 9/1972 |
| DE | 3839568 A1 | 5/1990 |

(Continued)

OTHER PUBLICATIONS

German Patent Office, German Search Report for German Application No. 102008023490.7, dated Jan. 23, 2009.

(Continued)

*Primary Examiner* — Kristina Fulton
*Assistant Examiner* — Nathan Cumar
(74) *Attorney, Agent, or Firm* — Ingrassia Fisher & Lorenz PC

(57) ABSTRACT

With a lock for a front hood of a motor vehicle, a locking pawl engages about a rotary latch. This engagement creates a positive connection of the locking pawl to the rotary latch perpendicularly to their intended movement directions. This prevents that during a crash of the motor vehicle the locking pawl is separated from the rotary latch and the lock therefore unlocked.

7 Claims, 2 Drawing Sheets

(51) Int. Cl.
*E05B 77/10* (2014.01)
*E05B 83/16* (2014.01)

(56) References Cited

U.S. PATENT DOCUMENTS

| | | | | | |
|---|---|---|---|---|---|
| 3,985,381 | A | * | 10/1976 | Kobayashi | 292/216 |
| 4,357,039 | A | * | 11/1982 | Tolle | 292/341.12 |
| 4,456,289 | A | * | 6/1984 | Badiali | 292/28 |
| 4,875,724 | A | * | 10/1989 | Gruber | 292/216 |
| 4,896,907 | A | * | 1/1990 | Hayakawa et al. | 292/216 |
| 4,917,420 | A | * | 4/1990 | Rogers, Jr. | 292/198 |
| 5,163,723 | A | * | 11/1992 | Ruckert | 292/216 |
| 5,618,069 | A | * | 4/1997 | Konchan et al. | 292/216 |
| 6,149,210 | A | * | 11/2000 | Hunt et al. | 292/216 |

FOREIGN PATENT DOCUMENTS

| | | | |
|---|---|---|---|
| DE | 19522721 | A1 | 1/1996 |
| DE | 10202344 | A1 | 4/2003 |
| DE | 10308678 | A1 | 9/2004 |
| DE | 10310916 | A1 | 9/2004 |
| DE | 102006031226 | A1 | 1/2008 |
| EP | 1067261 | A1 | 1/2001 |
| GB | 1229228 | A | 4/1971 |
| GB | 2345723 | A | 7/2000 |
| SU | 847905 | A3 | 7/1981 |

OTHER PUBLICATIONS

ISA European Patent Office, International Search Report for International Application No. PCT/EP2008/005345, dated Feb. 9, 2009.
ISA European Patent Office, IPRP for International Application No. PCT/EP2008/005345, dated Dec. 6, 2010.
UK IPO, British Examination Report for Application No. 1018977.7, dated Feb. 16, 2012.
Russian Patent Office, Russian Office Action for Application No. 2010150952, dated Mar. 8, 2012.
Chinese Patent Office, Chinese Office Action for Application No. 200880128859.3 dated May 24, 2012.

* cited by examiner

LOCK OF A HOOD OF A MOTOR VEHICLE

CROSS-REFERENCE TO RELATED APPLICATIONS

This application is a U.S. National-Stage entry under 35 U.S.C. §371 based on International Application No. PCT/EP2008/005345, filed Jul. 1, 2008, which was published under PCT Article 21(2) and which claims priority to German Application No. 102008023490.7, filed May 14, 2008, which are all hereby incorporated in their entirety by reference.

TECHNICAL FIELD

The invention relates to a lock of a hood of a motor vehicle with a lock case, with a rotary latch mounted in the lock case for the optional holding or releasing of a closing part and with a pivotably mounted locking pawl for supporting the rotary latch in the position of the rotary latch holding the closing part.

BACKGROUND

Locks are frequently employed in modern motor vehicles for locking front hoods opening in driving direction and are known from practice. The rotary latch of the known lock is preloaded into the release position of the closing part. If, starting out from the position of the rotary latch holding the closing part, the locking pawl is removed from the rotary latch the rotary latch moves into the position releasing the closing part. After this the front hood can be opened.

Disadvantageous with the known lock, however, is that in the event of a crash of the motor vehicle the locking pawl can be separated from the rotary latch. This subsequently leads to an undesirable opening of the front hood. The separation of the locking pawl from the rotary latch mostly occurs through a deformation of the lock case, as a result of which the components can for instance be tilted against each other. In this case, the rotary latch is no longer reliably supported by the locking pawl.

One could think about stiffening or providing the locking case with guides for the rotary latch and the locking pawl so as to prevent a separation of the rotary latch from the locking pawl during a crash of the motor vehicle. Such stiffeners or guides however lead to an increase of the constructional expenditure of the lock. Furthermore, the lock case can still be deformed in the event of a particularly severe crash and separation of the rotary latch from the locking pawl can nevertheless occur because of this.

In view of the foregoing, it is desirable to develop a lock of the type mentioned at the outset so that it can be particularly easily produced and makes possible a high level of protection against separation of the locking pawl from the rotary latch. In addition, other desirable features and characteristics will become apparent from the subsequent summary and detailed description, and the appended claims, taken in conjunction with the accompanying drawings and this background.

SUMMARY

According to an embodiment of the invention, the position of the rotary latch holding the closing part the locking pawl and the rotary latch are positively connected to each other towards both sides perpendicularly to their movement direction.

Through this configuration the connection of the component of the lock is affected through the positive connection of the locking pawl to the rotary latch. Since this positive connection occurs towards both sides perpendicularly to their intended movement directions, the release of the positive connection can only be effected through movement of the locking pawl in its intended movement direction. Releasing of the positive connection through tilting or perpendicular displacement of the locking pawl to the rotary latch as occurs during a crash of the motor vehicle is avoided thanks to the invention. Since the positive connection of the rotary latch with the locking pawl in the simplest case can be effected through suitable shaping of the components, the lock according to the invention only requires a particularly small number of components and can be produced particularly cost-effectively.

The positive connection of the rotary latch with the locking pawl according to an advantageous further embodiment of the invention is particularly simple in terms of design if in the position of the rotary latch holding the closing part the locking pawl engages about a leg of the rotary latch. Preferentially, the rotary latch is designed as so-called fork latch with two legs, wherein the closing part is held between the legs.

The constructional expenditure for the engaging configuration of the locking pawl according to another embodiment of the invention can be kept particularly low if in the position of the rotary latch holding the closing part the locking pawl comprises an arm and a folded portion, wherein the leg of the rotary latch is arranged between the arm and the folded portion. In a lateral view the arm and the folded portion thus form a U-shape between which the one leg of the rotary latch is arranged. Preferentially, arm and folded portion are produced unitarily of a sheet metal part.

According to another embodiment of the invention the assembly of the hood lock is particularly simple if the rotary latch and the locking pawl are pivotably mounted on bearing mandrels unilaterally mounted in the lock case.

To further simply the assembly of the lock it contributes if the lock case has a base with the bearing mandrels and lateral webs standing away from the base and if fastening flanges lead away from the free ends of the lateral webs. Furthermore, the lock mounted in the motor vehicle is particularly sturdy as a result.

The lock according to an embodiment of the invention is configured particularly compact if the rotary latch and the locking pawl are each preloaded in their intended position by a leg spring.

The folded portion can be arranged in almost any position of the locking pawl. The locking pawl however is particularly simple in design if the folded portion is unitarily produced with a hook and if the leg spring for preloading the locking pawl supports itself on the hook.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit application and uses. Furthermore, there is no intention to be bound by any theory presented in the preceding background or summary or the following detailed description.

Figure 1:
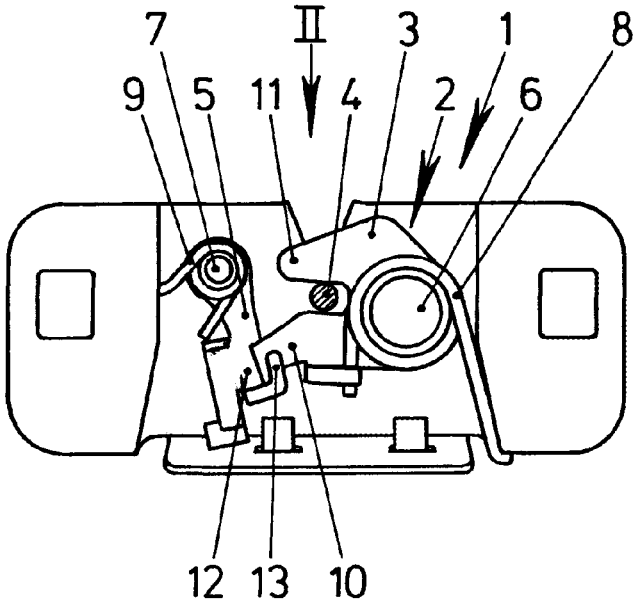
FIG. 1 is a lock according to an embodiment of the invention.

FIG. 1 shows a lock 1 of a front hood that is not shown of a motor vehicle with a lock case 2. In the lock case 2 a rotary latch 3 is pivotably mounted and engages about a closing part 4 shown schematically. The closing part 4 is thus positively held in the lock 1 by the rotary latch 3. This characterizes the locking position of the lock 1. The lock case 2 as a rule is fastened to a body part of the motor vehicle, while the closing part 4 is arranged on the front hood.

The rotary latch 3 is held in the shown locking pawl 5 likewise pivotably mounted in the lock case 2. The locking pawl 5 and the rotary latch 3 are each mounted on bearing mandrels 6, 7 fastened in the lock case 2 and are preloaded against each other by leg springs 8, 9. For supporting on the locking pawl 5 the rotary latch 3 comprises a leg 10. A second leg 11 engages about the locking part 4 in the locking position shown. If the locking pawl 5 is moved clockwise out of the movement region of the rotary latch 3 through a pivot movement, the rotary latch 3 is pivoted through the force of the leg spring 9 and releases the closing part 4. Thus the closing part 4 can be removed from the lock case 2.

The locking pawl 5 comprises an arm 12 with which it is passed through under the one leg 10 of the rotary latch 3. At the free end of the arm 12 folded portions 13 are routed back as far as over the arm 12. The one leg 10 is arranged between the arm 12 and the folded portion 13 and thus positively connected to the locking pawl 5 towards both sides perpendicularly to the movement direction of the rotary latch 3. Thus it is prevented that through a movement of the locking pawl 5 or the rotary latch 3 the components are separated from each other perpendicularly to the drawing plane and thus the movement of the rotary latch 3 is released.

Figure 2:
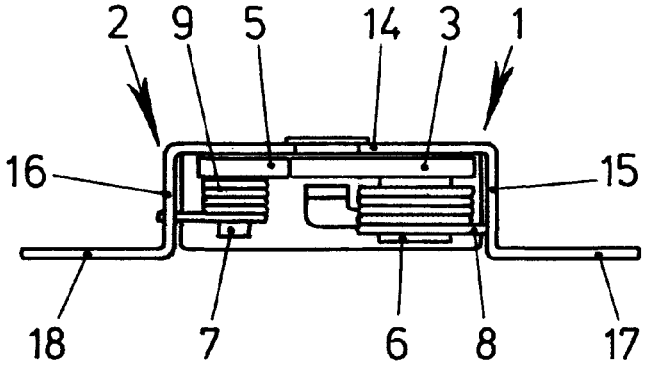
FIG. 2 is a view from Position II on to the lock according to the embodiment of the invention from FIG. 1.

In a view on to the lock 1 from Position II from FIG. 1, FIG. 2 shows that the lock case 2 comprises a base 14 with lateral webs 15, 16 standing away. At the free ends of the lateral webs 15, 16 fastening flanges 17, 18 stand away. Thus the lock case 2 can be easily fastened to the body part of the motor vehicle. The bearing mandrels 6, 7 for mounting the rotary latch 3 and the locking pawl 5 are fastened to the base 14. To simplify the drawing, the closing part 4 from FIG. 1 is not shown.

Figure 3:
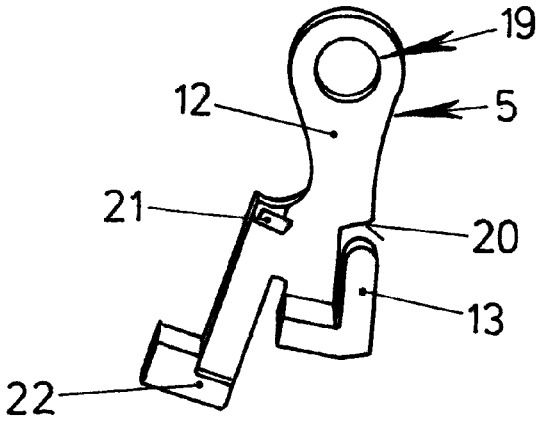
FIG. 3 is an enlarged a perspective representation of a locking pawl of the lock according to the embodiment of the invention from FIG. 1.

FIG. 3 shows enlarged the locking pawl 5 of the lock 1 from FIG. 1 in a perspective representation. There it can be seen that the locking pawl 5 has a bearing eye 19 for fitting on to the bearing mandrel 7 of the lock case 2. On the arm 12 a stop 20 for the rotary latch 3 and the folded portion 13 engaging about a leg 10 of the rotary latch 3 are arranged. Furthermore, the locking pawl 5 has a hook 21 for supporting the leg spring 9 and a triggering arm 22. The locking pawl 5 is formed of a flat sheet metal part.

Figure 4:
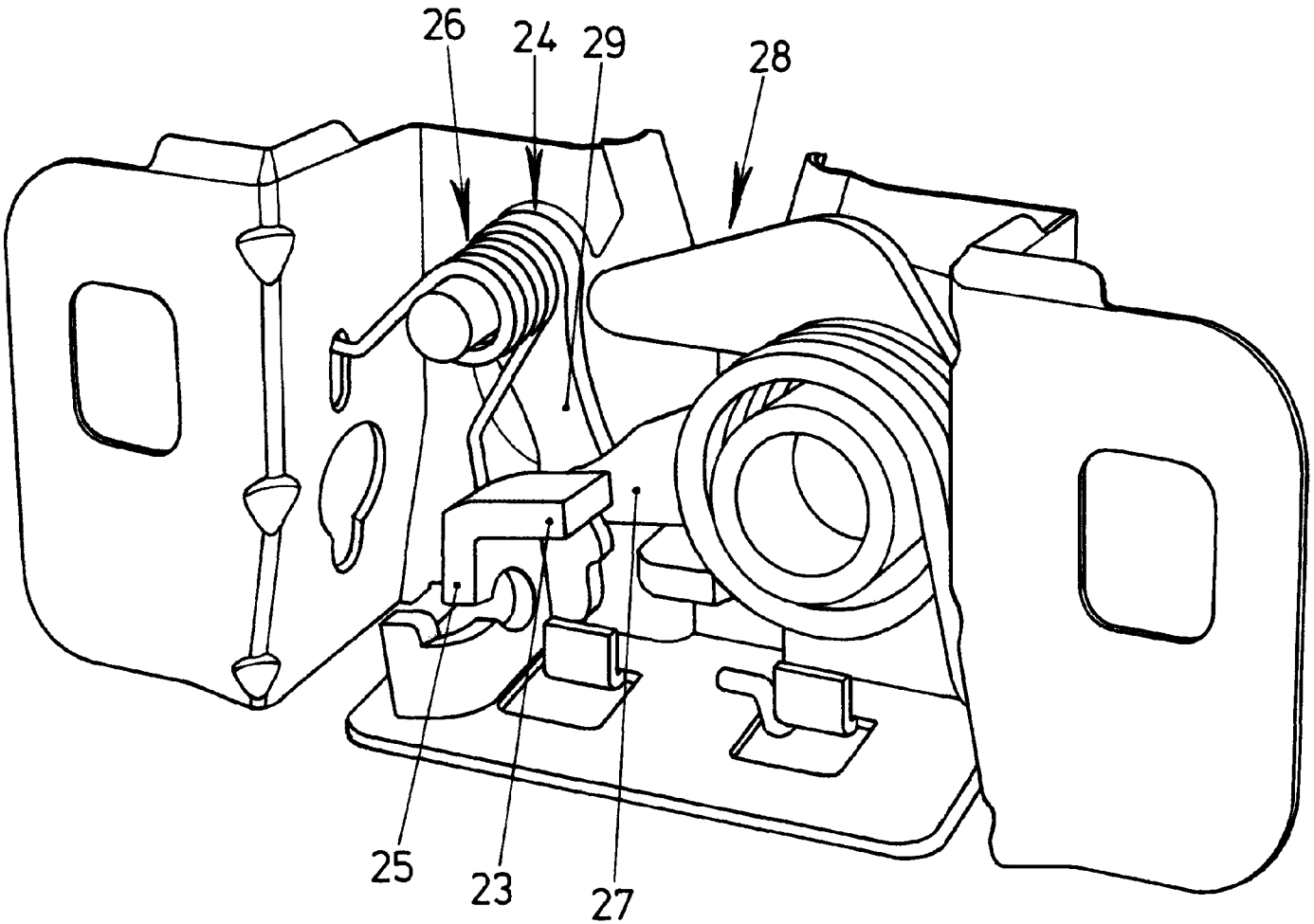
FIG. 4 is a further embodiment of the lock according to an embodiment of the invention.

FIG. 4 shows a further embodiment of the lock according to the invention, which differs from that from FIG. 1 only in that a folded portion 23 is arranged on a locking pawl 24 on a hook 25. A leg spring 26 supports itself on the hook 25. As with the embodiment according to FIG. 1, a leg 27 of a rotary latch 28 is arranged between the folded portion 23 and an arm 29 of the locking pawl 24. Otherwise the construction of this embodiment corresponds to the embodiment described in the FIG. 1 to FIG. 3.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

The invention claimed is:

1. A lock of a hood of a motor vehicle, comprising:

a lock case;

a rotary latch mounted in the lock case and including a leg disposed on a first plane;

a closing part adapted to be held by the rotary latch;

a pivotably mounted locking pawl adapted to support the rotary latch in a position of the rotary latch that holds the closing part, wherein the pivotably mounted locking pawl includes an arm disposed on a second plane and a folded portion disposed on a third plane that is separated from the second plane and folded back over the arm, wherein the arm and the folded portion define a gap, wherein in the position of the rotary latch that holds the closing part, the leg of the rotary latch is disposed directly in the gap at least partially surrounded by the arm and the folded portion of the pivotably mounted locking pawl to restrict separation of the leg and the arm perpendicularly to a movement direction of the rotary latch, and wherein the first plane is at least partially disposed between the second plane and the third plane within the lock.

2. The lock according to claim 1, wherein in the position of the rotary latch that holds the closing part, the pivotably mounted locking pawl is adapted to engage about the leg of the rotary latch.

3. The lock according to claim 1, wherein the rotary latch and the pivotably mounted locking pawl are pivotably mounted on a bearing mandrel mounted on a side in the lock case.

4. The lock according to claim 3, wherein the lock case comprises a base with the bearing mandrel and a lateral web standing away from the base and a fastening flange is lead away from free ends of the lateral web.

5. The lock according to claim 1, wherein the rotary latch and the pivotably mounted locking pawl are preloaded in an intended position by a leg spring.

6. The lock according to claim 1, wherein the folded portion is unitarily produced with a hook and in that a leg spring is adapted to preload the pivotably mounted locking pawl such that the locking pawl supports itself on the hook.

7. The lock according to claim 1, wherein the first, second, and third planes are substantially parallel to each other.

* * * * *